United States Patent [19]

Bears et al.

[11] 4,392,810

[45] Jul. 12, 1983

[54] OIL BURNER

[75] Inventors: John D. Bears, Belle River; Kenneth R. D. Emery, Wood Islands, both of Canada

[73] Assignee: Ener-Tech Heating Systems Inc., Prince Edward Island, Canada

[21] Appl. No.: 222,752

[22] Filed: Jan. 5, 1981

[30] Foreign Application Priority Data

Jan. 29, 1980 [CA] Canada ..... 344575

[51] Int. Cl.[3] ..... F23N 1/00

[52] U.S. Cl. ..... 431/37; 431/11; 431/208

[58] Field of Search ..... 431/36, 37, 11, 208

[56] References Cited

U.S. PATENT DOCUMENTS 1,766,133 6/1930 Lanser ..... 431/37

2,876,830 3/1959 Duy ..... 431/36

FOREIGN PATENT DOCUMENTS 512343 2/1973 U.S.S.R. ..... 431/36

*Primary Examiner*—William E. Wayner

*Attorney, Agent, or Firm*—LeBlanc, Nolan, Shur & Nies

[57] ABSTRACT

An oil feed system for an oil burner is disclosed. The feed system includes an oil preheater through which the oil is pumped to ensure that the oil fed to the burner nozzle is warm enough to ignite easily and completely. A purge line is provided to recirculate the standing oil in the supply line which leads to the burner nozzle back through the heater so that on start up cold oil is not sprayed from the nozzle. A solenoid valve in the purge line opens for a predetermined time initially during which oil is recirculated. It is not necessary to close off the burner nozzle during this period because the nozzle presents a considerably higher resistance to the oil than the purge line which is connected through the solenoid valve to the suction side of the feed pump with the result that the cold oil flows directly to the purge line.

10 Claims, 7 Drawing Figures

OIL BURNER

BACKGROUND OF THE INVENTION

This invention relates to an oil feed system for an oil burner and, more particularly, to such a system in which a purge line is provided to recirculate standing cold oil through an oil preheater.

Such systems have been proposed previously but in general they have suffered from the drawback that they do not purge the standing oil right back from the nozzle and so a slug of unheated oil is injected into the nozzle shortly after start-up. Particularly in the case of used lubricating oil (waste oil) this unheated slug fails to ignite properly and can cause smoke and, possibly also, partial blocking of the nozzle after continued use.

In other systems where the purge line has been brought right up to the nozzle relatively complicated valve arrangements have been required and, in particular, structure for closing off the burner nozzle to the supply of oil has been incorporated.

It is an object of the present invention to provide an oil feed system for an oil burner which provides a cold purge phase in a simple and effective manner with an absence of expensive components.

SUMMARY OF THE INVENTION

According to a broad aspect of the present invention, there is provided an oil burner feed system comprising first pump means connected in a line between an oil storage tank and an inlet of an oil heater, an oil supply line having an inlet connected to an outlet of the oil heater and an outlet connected to a burner nozzle, a purge line having an inlet adjacent the point of connection between the nozzle and the oil supply line and constant open communication with both the nozzle and the outlet of the oil supply line, second pump means connected in the purge line and an inlet of the oil heater, valve means in the purge line and control circuitry arranged to open the valve means on start-up of the feed system for a predetermined time interval whereby during the predetermined time interval oil is circulated through the oil supply line from the oil heater and through the purge line back to the heater.

It should be noted that there is constant open communication between the nozzle and the oil supply line outlet at all times even during the purge phase. No complicated valve means for closing off the burner nozzle during the purge phase is necessary according to the invention because the suction obtained in the purge line when the valve means is open combined with the inherent nozzle resistance prevents oil from passing through the nozzle.

According to a preferred embodiment of the invention, the first and second pump means are incorporated in a single fuel pump which has a first inlet connected to the storge tank, a second inlet connected to the purge line and a common outlet connected to a common inlet of the oil heater.

The term "purge" is used above to describe the recirculation of standing cold oil through the heater and it is primarily this "purging" that the present invention is concerned with. However as an ancillary feature, the present invention provides another "purge" function which involves a delay valve in the oil supply line which prevents oil from reaching the nozzle, even when the purge line is closed, until at least 6 seconds have elapsed. During this period any combustible gases in the combustion chamber are swept out by the burner blower thus preventing the danger of explosion on ignition.

A particularly useful type of oil heater contemplated in a preferred embodiment of the invention is a heat exchanger comprising two containers, one inside the other. The inner container has an inlet for the oil and an oil outlet and is immersed in a water/antifreeze solution contained in the outer container. An electric heating element is also immersed in the water/antifreeze solution.

Preferably the heater temperature is maintained around 200° F. by a dual reverse acting aquastat such that, in the event of heater failure the oil feed system is deenergised thus preventing cold oil from being sprayed from the nozzle.

BRIEF DESCRIPTION OF THE DRAWINGS

The invention will now be described in greater detail with reference to the accompanying drawing in which.

DESCRIPTION OF THE PREFERRED EMBODIMENT

Figure 1:
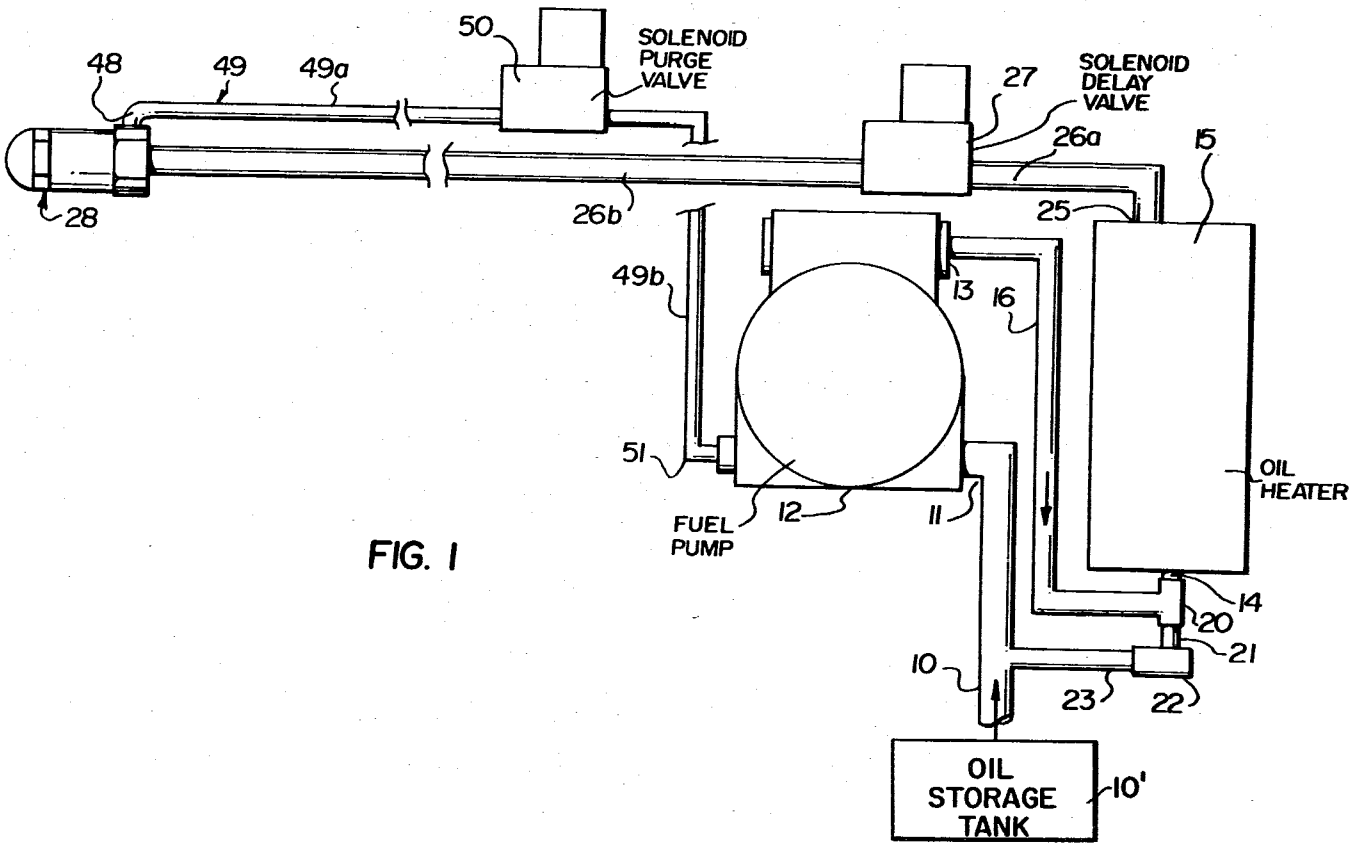
FIG. 1 is a schematic view showing the important components of an oil burner feed system according to the invention.
Figure 2:
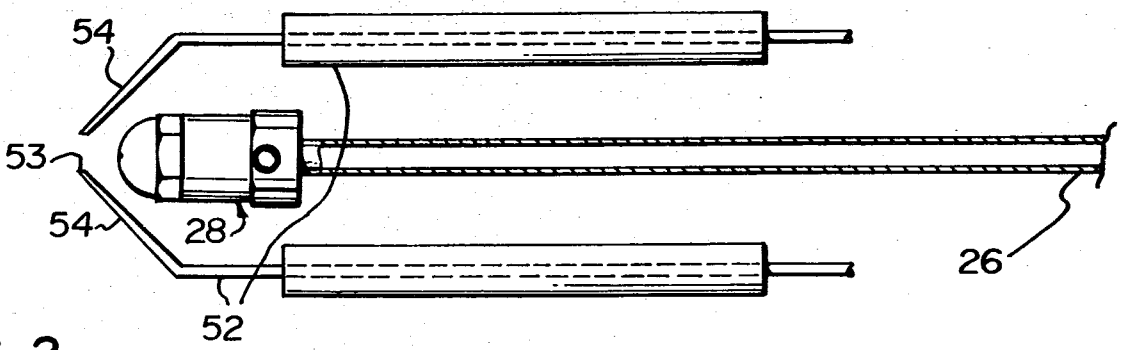
FIG. 2 is a longitudinal sectional view of a portion of the oil burner feed system of FIG. 1.

With reference firstly to FIGS. 1 and 2, an oil burner feed system according to the invention includes an oil line 10 connected to an outlet of an oil storage tank 10' and connected to an inlet 11 of a fuel pump 12. An outlet 13 of pump 12 is connected to an inlet 14 of an oil preheater 15 by means of an oil line 16 and a tee connection or fitting 20.

Inlet 14 of heater 15 is also in communication via tee 20 with a line 21, a pressure relief valve 22 and a line 23 to line 10. For a pump supply pressure of 100 p.s.i. the pressure relief would be set at 120 p.s.i.

Heater 15 has an outlet 25 to which is connected a first portion **26*a* of an oil supply line 26, portion 26*a* leading to a solenoid valve 27 which is normally closed and which has a built in delay of 6 seconds after energisation before opening. A second portion 26*b* of supply line 26 leads from solenoid valve 27 to a nozzle assembly 28**.

Figure 3:
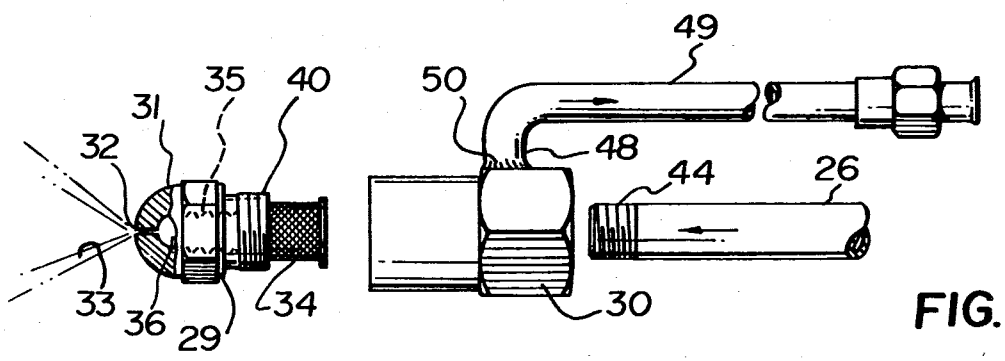
FIG. 3 is an exploded view showing a detail of the burner feed system of FIG. 1.
Figure 4:
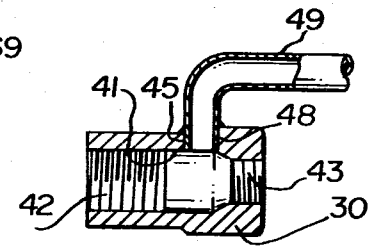
FIG. 4 is a sectional view of a portion of FIG. 3.

With particular reference to FIGS. 3 and 4 in conjunction with FIGS. 1 and 2, it can be seen that nozzle assembly 28 comprises a conventional oil burner nozzle 29 and an adaptor 30. As nozzle 29 is conventional it is considered unnecessary to describe it in great detail. Typically such nozzles have a rounded forward end 31 having a single aperture. In FIG. 3 the aperture is denoted schematically by reference numeral 32 and the resultant conical spray emanating from the aperture is denoted by reference numeral 33. The conventional nozzle also includes a filter element 34 at an input end thereof and between the filter element 34 and the apertures 32 are located oil conveying passageways 35 and a vortex chamber 36. An externally threaded body portion 40 is provided concentrically around the filter element 34 but the filter element projects rearwardly further than the threaded body portion 40.

The adaptor 30 is formed as a sleeve having a stepped through bore 41 one end of which is formed with an internal thread 42 configured to receive the threaded portion 40 of the nozzle 29. The other end of bore 41 is formed with a reduced diameter internal thread 43 for receiving an externally threaded end portion 44 of supply line portion **26*b*. Adjacent thread 43 and extending perpendicularly with respect to bore 41 through the wall of the adaptor is a hole 45 which is sized and configured to receive in close fit an angled end portion 48 of a purge line 49 which is welded to the outer surface of adaptor 30 at weld bead 50. The adaptor is formed with hexagonally arranged flats to permit tightening of the nozzle and oil line 26** to the adaptor.

Purge line 49 is formed as a first portion **49*a* leading to a normally closed solenoid valve 50 (FIG. 1) and a second portion 49*b* leading to a second inlet 51 of fuel pump 12**.

As can be seen in FIG. 2 a pair of electrodes 52 is provided in conventional manner, these defining a spark gap 53 at their tips 54 for igniting the oil spray emanating from the nozzle. The nozzle and spark gap are disposed in a conventional furnace burner (not shown).

Figure 5:
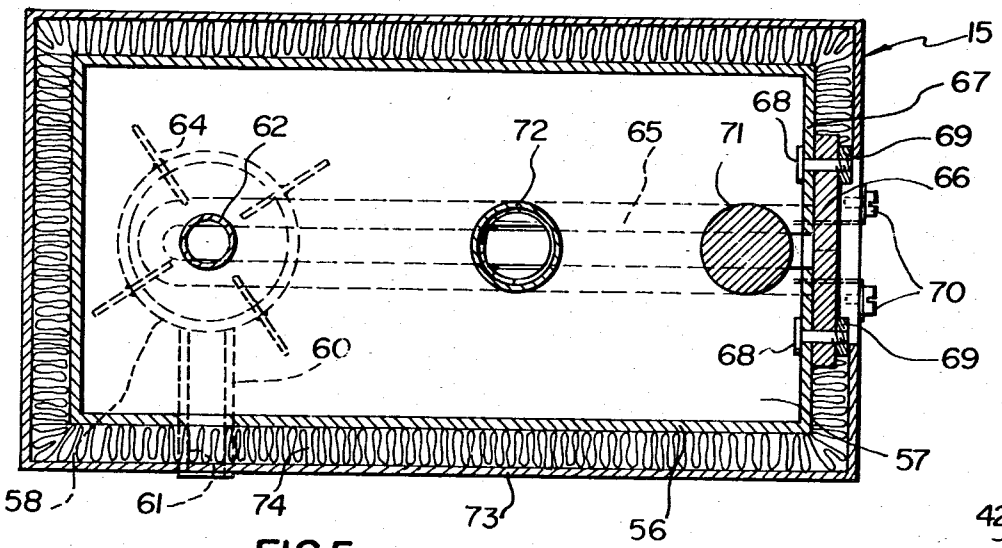
FIG. 5 is a top view of an oil preheater used in the system of FIG. 1.

Reference should now be made to FIG. 5 for a detailed understanding of the oil heater 15. The heater 15 is formed as a heat exchanger having an outer rectangular container 56 containing a water/antifreeze solution 57 and an inner container formed as a vertical tube 58 extending from about ¼ of the distance from the bottom of container 56 to a point flush with the inner surface of the top of container 56. Container 58 is totally immersed in the water/antifreeze solution 57.

An oil inlet tube 60, which corresponds to inlet 14 shown in FIG. 1, extends horizontally from the lower portion of inner container 58 and projects outwardly of the outer container 56 via a suitable hole 61. Inlet 60 is threaded at its outer end for connection to tee 20 (FIG. 1). An oil outlet tube 62 which corresponds to outlet 25 of FIG. 1 projects vertically and centrally from the top of inner container 58 through the top wall of outer container 56. Outlet 62 is threaded for connection to line 26 (FIG. 1). Inner container 58 is completely closed apart from oil inlet tube 60 and oil outlet tube 62 so that the inside of inner container 58 is completely sealed from the water/antifreeze solution in the outer container 56. Four vertical elongate fin members 64 are welded to container 58, the fins being equally spaced around the periphery of container 58 and each projecting an equal amount radially inwardly and radially outwardly of container 58. The purpose of fins 64 is to assist the heat transfer between the water/antifreeze solution and oil as the oil passes through the inner container 58.

An electric heating element 65 is immersed in solution 57 contained in outer container 56 and extends horizontally beneath inner container 58. Element 65 is provided with a mounting plate 66 which is fastened to the outer surface of side wall 67 of outer container 56 by means of studs 68 and nuts 69. Two electrical connectors 70, in the form of screw terminals, for connecting a power supply to the element 65 are provided on the outer surface of mounting plate 66 and in electrical communication with opposite ends of element 65.

Projecting downwardly through a hole in the top of container 56 and into the water/antifreeze solution is an aquastat 71 of conventional design. The aquastat is secured to the top of container 56 and its operation will be described below with reference to FIG. 6.

Also provided in the top of container 56 is a fitting 72, which may be an internally threaded tube, for a pressure relief valve connecting pipe (not shown); this is a safety valve for protecting outer container 56 by providing a pressure relief for the solution 57 if the pressure rises above 30 p.s.i.

Surrounding the entire outside surface of outer container 56, except where members 60,62,68 and 71 are disposed, is an outer casing 73 which is spaced from the walls of container 56. The space thus defined is filled with thermal insulation 74.

Figure 6:
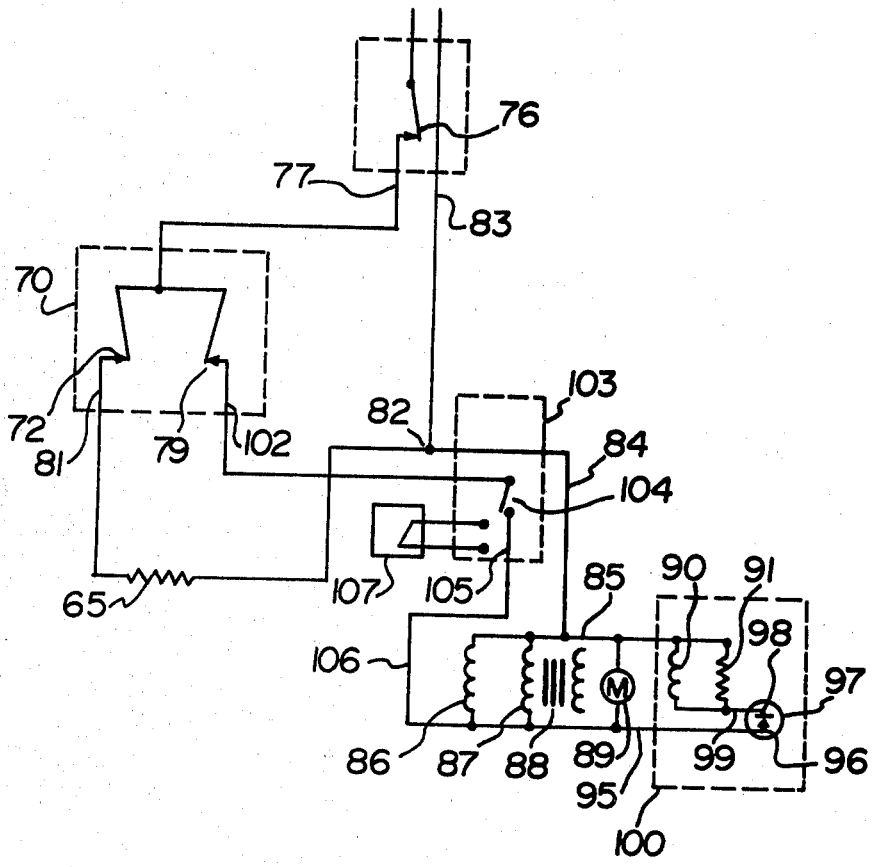
FIG. 6 is a schematic diagram showing typical electrical components and connections for the oil burner feed system of FIG. 1.

Reference should now be made to FIG. 6 for an understanding of the electrical components and connections used in the system. A master or service switch 76 is connected to the electrical supply circuit (not shown) and serves to make or break connection to the remainder of the circuitry. One output wire 77 is connected as an input to the aquastat 70 which is a conventional dual reverse acting aquastat (liquid thermostat) having a first contact which opens when a first predetermined maximum temperature is reached and a second contact which closes when a second predetermined maximum temperature is reached. The first and second contacts are shown schematically by reference numerals 72 and 79, contact 72 being set to open when the temperature rises to 200° F. and contact 79 being set to close when the temperature rises to 190° F. (The temperature under consideration is, of course, that of the water/antifreeze solution which will be similar to that of the oil after it is heated).

It can be seen that wire 77 is connected to the joint input side of both contacts 72 and 79. The output side 81 of contact 72 is connected in series with the heater element 65 and then to a junction point 82 of the other output wire 83 of service switch 76. Junction point 82 is then connected via wire 84 to a bus 85 to which are connected one side of each of a solenoid coil 86, the primary winding 87 of an ignition transformer 88 the secondary winding of which is connected to electrodes 52 (FIG. 2), an electric motor 89, a solenoid coil 90 and a resistor 91. Solenoid coil 86 forms part of solenoid valve 27 of FIG. 1, motor 89 drives fuel pump 12 of FIG. 1 and also drives a blower (not shown) for supplying air to the burner in the conventional manner, and solenoid coil 90 forms part of solenoid valve 50 of FIG. 1. The other sides of coil 86, primary winding 87 and motor 89 are connected to a second bus 95.

Also connected to bus 95 is one terminal 96 of a varistor 97 the other terminal 98 of which is connected to the other sides of coil 90 and resistor 91 via wire 99. The combination of coil 90, resistor 91 and varistor 98 is described as a purge circuit 100.

The output side 102 of aquastat contact 79 is connected to a primary ignition control 103 which is of conventional design and is represented schematically as a normally open contact 104 which is closed by means of an electrically operated relay (not shown) which in turn is energized by the closing of thermostat 107. The output side 105 of contact 104 is connected to bus 95 by wire 106.

The oil burner system described above operates as follows. With service switch 76 closed power flows through wire 77, through aquastat contact 72, through heating element 65 and junction 82 and back through wire 83, thus energising element 65. Heat is transferred to the water/antifreeze solution and from that solution to oil contained in inner container 58. When the temperature of the water/antifreeze solution reaches 190° F. aquastat contact 79 closes thus completing the power circuit through wire 77 contact 79, wire 102 primary control 103, wire 106, bus 95 and through all the parallel connected components 86, 87, 89 and purge circuit 100 to bus 85 and back through wire 84, junction 82 and wire 83.

Energisation of coil 90 causes purge solenoid valve 50 to open and virtually simultaneously energisation of motor 89 causes the blower and pump 12 to start. The blower causes any gas which may have collected in the burner to be swept out or purged before ignition takes placed. Energisation of solenoid coil 86 causes after a 6 second built-in delay opening of valve 27 and at that time oil is pumped from heater outlet 25 via pipe 26, adaptor 30, purge line 49, pump inlet 51, pump 12, pump outlet 13 and back to heater inlet 14. In this way the standing slug of cold oil in supply pipe 26 is circulated back through preheater 15 before any oil actually reaches the nozzle 29 itself. It should be noted that the reason why the oil during this start-up phase is not forced through the nozzle is that the open purge valve 50 causes a vacuum obtained at pump inlet 51 to be communicated to nozzle adaptor 30 via purge line 49 and so the purge line inlet 48 presents a very much lower resistance to oil flow than the narrow passages and aperture of the nozzle per se.

Purge circuit 100 operates as a timer or, more particularly, resistor 91 and varistor 97 operate as a timer. When the supply voltage is first applied as described above the voltage drop across varistor 97 is relatively small and the voltage across the resistor 91 is, consequently, relatively high so that the current flowing through varistor 97 and solenoid coil 90 is sufficiently high to operate the solenoid valve 50. As varistor 97 heats up due to the $I^2R$ loss its resistance increases and after a time interval depending on the value of the resistor and the characteristics of the varistor and coil 90, the voltage drop across varistor 97 rises so high that the voltage drop across coil 90 drops to a value at which the current passed is insufficient to open to the solenoid valve 50. Thus, solenoid valve 50 is closed and the oil, instead of being passed through purge line 49, is forced through nozzle 29 resulting in the spray 33 shown in FIG. 3. Since electrodes 54 had previously been energised by ignition transformer 88 the spray 33 is ignited by the spark existing across gap 53 and ignition of the preheated oil occurs in the combustion chamber.

It should be apparent that because varistor 97 is being continuously energised during the ignition and running phase of the burner, it remains effectively switched off and purge valve 50 remains closed. Purge valve 50 will not open again unless the power supply to purge circuit 100 (and to components 86, 87 and 95) has been interrupted for a time interval sufficiently long to enable varistor 97 to cool down appreciably so that varistor 97 will switch on. The normal cycling of primary control 103 will not normally interrupt power for such a sufficiently long period but when the thermostat is lowered considerably such as at night time or if the burner circuit is shut down temporarily varistor 97 will have sufficient time to cool to a point where it is switched on so that when power is once more applied the purge phase will be carried out again. During normal running of the burner, the purge valve 50 is closed and oil from the storage tank is fed through heater 15 to the nozzle. During periods when the burner is not operating excess pressure produced when the oil is being heated is bled through relief valve 22 back into oil line 10.

It should be clear that an advantage of the particular design of purge circuit described is that the purge phase is initiated only when necessary, i.e. only when the slug of oil in pipe 26 has been standing sufficiently long that its temperature has dropped below an optimum ignition value. Typically the resistor 91 could have a value of 250Ω using a varistor manufactured by PHILLIPS ELECTRONICS and identified as P.N. 9322-662-93002 which has a variable resistance of approximately 18 ohms. For a 110 volt supply this provides a purge duration of approximately 15 seconds which is sufficient for a supply pipe of 18 ins. in length. A time interval of approximately 5 minutes during which no power is supplied to the purge circuit is required before the purge circuit will switch on on resumption of power.

During the entire time that the service switch is closed, contact 72 of aquastat 70 is continuously cycling causing heater 65 to maintain the preheater temperature around 200° F. If there is a heater failure contact 79 will open preventing power from reaching bus 85 and so preventing cold oil from being sprayed into the combustion chamber .

The burner system described above will burn #2 fuel oil and waste lubricating oil with comparable results. The only change required is that for use with waste oil rather than fuel oil a slight adjustment to the conventional primary air control is necessary to ensure complete combustion. Providing the waste oil is properly filtered and clean, virtually maintenance free burning is obtained. Waste oil obtained from garages may be used alone or mixed in various proportions with fuel oil. A sample of waste oil which was burned satisfactorily in a burner system as described above and a sample of the resultant ash in the form of a grey powder were analysed, the results being set down below.

WASTE OIL SAMPLE

| | | | | |
|---|---|---|---|---|
| Density at 15° C. | 0.8795 | (API Grav. at 60° F. 29.3) | Analysis of Ash - | |
| Ash | 0.85% | | Silica | 10.08% |
| Sediment & water | 2.0% | | Aluminium | 23.23 |
| Viscosity at 38°.9C. | 21.52 | cSt | Calcium | 20.68 |
| Sulphur | 0.49% | | Lead | 13.12 |
| BTU/lb | 19 317 | (Cal/g - 10 734) | Sodium | 4.26 |
| BTU/gal | 170 217 | | Iron | 2.46 |
| | | | Zinc | 1.86 |
| | | | Potassium | 1.86 |
| | | | Magnesium | 1.78 |
| | | | Copper | 0.62 |
| | | | Manganese | 0.18 |

ASH SAMPLE

| | |
|---|---|
| Moisture | 0.05% |
| Loss on ignition | 7.00% |
| Silica | 37.61% |
| Iron | 7.9% |
| Aluminium | 6.9% |
| Calcium | 6.8% |
| Lead | 5.8% |

-continued

| ASH SAMPLE | |
|---|---|
| Potassium | 2.0% |
| Sodium | 1.2% |
| Manganese | 1.2% |
| Copper | 1.1% |
| Magnesium | 0.4% |
| Zinc | 0.4% |

Figure 7:
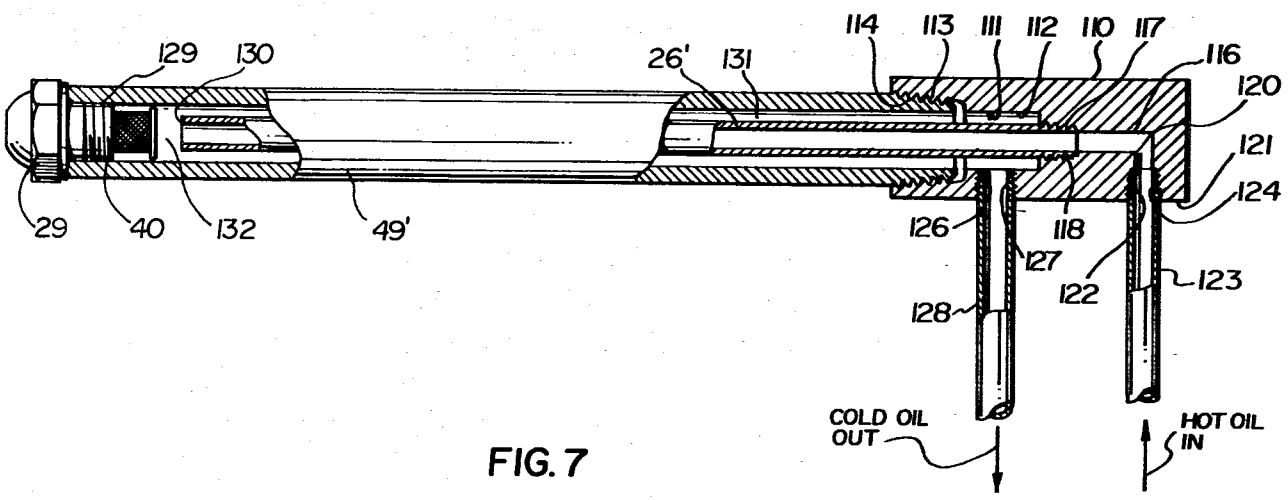
FIG. 7 is a sectional view of a modified portion of the burner feed system of FIG. 1.

FIG. 7 shows a purge line according to a modification of the present invention. According to this modification the purge line 49' is arranged concentrically around supply line 26' and a special adapter block 110 is provided for interconnecting these lines with pump inlet 51 and heater outlet 25 respectively and through solenoid valves 50 and 27 respectively. Adapter block 110 is provided with a stepped bore 111 having a relatively large diameter forward portion 112 which is threaded internally at its forward portion 113 which receives an externally threaded rear portion 114 of purge line 49'. Bore 111 also has a reduced diameter rear portion 116 which is internally threaded at its forward portion 117 which receives an externally threaded rear portion 118 of supply line 26'.

Bore portion 116 has a right bend 120 and opens out to a surface 121 of adapter 110 at an internally threaded portion 122. A pipe 123 which is externally threaded at its forward end 124 connects bore portion 116 with heater outlet 25. An internally threaded bore 126 extends perpendicularly from bore portion 112 out to surface 121 and receives a forward threaded portion 127 of a pipe 128 which connects bore portion 112 with pump inlet 51.

The forward end of purge line 49' is straight (instead of being angled as in the FIG. 1 embodiment) and is internally threaded at 129. External thread 40 of nozzle 29 engages thread 129 to secure nozzle 29 to the forward end of purge line 49'. The forward end 130 of supply line 26' stops short of the filter 34 of nozzle 29 so that the bore of supply line 26' communicates with the annular space 131 between lines 26' and 49' via the space 132 between the filter and forward end 130 of the supply line.

The system operates in exactly the same way as described above for the first embodiment described.

Although preferred embodiments of the present invention have been described and illustrated, it will be apparent to those skilled in the art that various modifications may be made without departing from the principles of the invention. For example, instead of solenoid coil 86 and transformer 88 as well as burner motor 89 being connected directly to primary ignition control 103, only burner motor 89 may be connected directly to the primary ignition control, coil 86 and transformer 88 being connected through an adjustable timer which would be set, typically, for a time delay of 10 seconds. Thus, when power is applied through the primary ignition control only the burner motor is energised during the first 10 seconds during which time the associated blower sweeps out or purges gas which may have collected in the combustion chamber. At the end of this period, transformer 88 is energised to energise the electrodes and solenoids 86 and 90 are energised to open valves 27 and 50 respectively. As before, the oil is purged through the heater until the varistor timer closes valve 50 at which time the heated oil passes to the burner nozzle where it is ignited by the electrodes. In this modification, valve 27 does not need a built-in delay and opens at the same time as purge valve 50. The primary difference is that the electrodes 54 are not energized until after the initial 10 second air purge so removing completely any danger of ignition of collected gases.

What we claim as our invention is:

1. An oil burner feed system comprising first pump means connected in a line between an oil storage tank and an inlet of an oil heater, an oil supply line having an inlet connected to an outlet of the oil heater and an outlet connected to a burner nozzle, a purge line having an inlet adjacent the point of connection between the nozzle and the oil supply line and in constant open communication with both the nozzle and the outlet of the oil supply line, second pump means connected in the purge line and an inlet of the oil heater, valve means in the purge line and control circuitry arranged to open the valve means on start-up of the feed system for a predetermined time interval whereby during the predetermined time interval oil is circulated through the oil supply line from the oil heater and through the purge line back to the heater.

2. An oil burner as claimed in claim 1 wherein the first pump means and the second pump means are formed as a single fuel pump having a first inlet connected to the storage tank, a second inlet connected to the purge line and a common outlet connected to a common inlet of the oil heater.

3. An oil burner as claimed in claim 1 including an adaptor to which the nozzle, the outlet end of the supply line and the inlet end of the purge line are secured, the adaptor having passage means interconnecting the nozzle, the outlet end of the supply line and the inlet end of the purge line.

4. An oil burner as claimed in claim 3 where the adaptor is formed as a hollow tube having a through bore to one end of which is secured the nozzle and to the other end of which is secured the outlet end of the supply line and having a through hole in the wall of the tube intersecting the bore, the inlet end of the purge line being secured in the through hole.

5. An oil burner as claimed in claim 1 wherein the purge line is formed concentrically around the oil supply line to define an annular space, a forward end of the purge line projecting beyond a forward end of the oil supply line and securing the nozzle which is spaced from the forward end of the oil supply line to define a space communicating with the annular space.

6. An oil burner as claimed in claim 1 including valve means in the oil supply line, the control circuitry being arranged to open the valve means after a second predetermined time on start up, the second predetermined time being shorter than the first predetermined time.

7. An oil burner as claimed in claim 1 wherein the valve means is a solenoid valve having a solenoid coil and wherein the control circuitry includes a resistor connected in parallel with the solenoid coil and a varistor connected in series with the parallel combination of the resistor and solenoid coil, the series parallel combination being connected through a primary control to a power source.

8. An oil burner as claimed in claim 7 wherein the primary control is connected through an aquastat to the power source, the aquastat being positioned in the oil heater and having a normally open contact which closes when a first predetermined maximum temperature is reached.

9. An oil burner as claimed in claim 8 wherein the aquastat also has a normally closed contact which opens when a second predetermined maximum temperature is reached, the second predetermined maximum temperature being greater than the first predetermined maximum temperature, the normally closed contact being connected in series with a heating element of the oil heater to the power source.

10. An oil burner as claimed in claim 1 wherein the oil heater comprises an outer container filled with water-/antifreeze solution and an inner container substantially surrounded by the water/antifreeze solution, a heater element immersed in the water/antifreeze solution, the inner container having an inlet for oil and an outlet for oil.

* * * * *